US011793243B2

(12) United States Patent
Xu

(10) Patent No.: US 11,793,243 B2
(45) Date of Patent: Oct. 24, 2023

(54) HIGH-ELASTIC, LIGHTWEIGHT AND COMFORTABLE UNDERWEAR AND A PRODUCTION PROCESS THEREOF

(71) Applicant: Zhennan Xu, Fujian (CN)

(72) Inventor: Zhennan Xu, Fujian (CN)

(73) Assignee: Xiamen Hexin Technology Co., Ltd., Fujian (CN)

( * ) Notice: Subject to any disclaimer, the term of this patent is extended or adjusted under 35 U.S.C. 154(b) by 82 days.

(21) Appl. No.: 17/136,024

(22) Filed: Dec. 29, 2020

(65) Prior Publication Data

US 2022/0071310 A1 Mar. 10, 2022

(30) Foreign Application Priority Data

Sep. 9, 2020 (CN) ..... 202010939575.5

(51) Int. Cl.

| | |
|---|---|
| ***A41B 9/00*** | (2006.01) |
| ***A41B 9/16*** | (2006.01) |
| ***D06C 7/02*** | (2006.01) |
| ***D06C 13/00*** | (2006.01) |
| *A41B 17/00* | (2006.01) |

(52) U.S. Cl.

CPC ..... *A41B 9/001* (2013.01); *A41B 9/16* (2013.01); *D06C 7/02* (2013.01); *D06C 13/00* (2013.01); *A41B 17/00* (2013.01)

(58) Field of Classification Search

CPC ..... A41B 11/125; A41B 2500/50; A41B 2400/82; A41B 2400/80; D06C 13/00

See application file for complete search history.

(56) References Cited

U.S. PATENT DOCUMENTS 2,223,621 A * 12/1940 Knappenberger ..... A41F 9/00 2/237
2,289,679 A * 7/1942 Porter ..... A41C 3/144 450/57
2,561,777 A * 7/1951 Bernstein ..... A41F 11/02 2/337
2,697,230 A * 12/1954 Rosecrans, Sr. ..... A41F 11/16 2/337
2,837,748 A * 6/1958 Manning ..... A41F 9/00 2/337

(Continued)

*Primary Examiner* — Richale L Quinn

(57) ABSTRACT

The invention disclosed a high-elastic, lightweight and comfortable underwear and a production process thereof, comprising underwear inner-layer and underwear outer-layer, wherein elastomeric strips are provided between the underwear inner-layer and underwear outer-layer. The production process comprises the following steps: 1) printing the elastomeric strip shapes; 2) pressing elastomeric strips; 3) cutting residual material; 4) finishing garment. Compared to the prior, the invention has the following advantageous effects: the invention is with simple structure and easy to manufacture, the invention can provide sufficient support and sufficient binding force for users while the skin is not be squeezed, the elastomeric strips can replace traditional rubber bands, steel rings, stabilized yarn, and etc, which has high-quality support performance to achieve shaping effect, and has excellent elasticity and resilience to facilitate design and manufacture with no worries of size, moreover, the invention is washable and not easy to deform.

1 Claim, 3 Drawing Sheets

(56) References Cited

U.S. PATENT DOCUMENTS 3,253,599 A * 5/1966 Bjorn-Larsen ..... A41B 11/128 450/150
3,478,748 A * 11/1969 Bjorn-Larsen ..... A41F 11/18 450/106
3,496,944 A * 2/1970 Cuozzi ..... A41B 11/126 2/407
3,590,390 A * 7/1971 Howard ..... A41B 11/126 2/312
3,590,823 A * 7/1971 Pope, Jr. ..... A41F 11/18 450/95
3,854,978 A * 12/1974 Campbell, Sr. ..... D06N 7/0092 2/221
3,930,090 A * 12/1975 Campbell, Sr. ..... A41F 9/00 428/196
6,059,834 A * 5/2000 Springs ..... A61F 2/7812 623/32
6,332,825 B1 * 12/2001 Henricksen ..... A41F 15/00 450/1
6,446,268 B1 * 9/2002 Lazarian ..... A41F 9/00 427/256
7,640,602 B2 * 1/2010 Chetelat ..... A41F 9/00 2/256
7,861,324 B2 * 1/2011 Chetelat ..... A41C 1/14 450/143
7,908,674 B2 * 3/2011 Jones ..... A41B 11/125 450/106
8,176,864 B2 * 5/2012 Angelino ..... A41D 27/245 112/440
8,272,507 B1 * 9/2012 Crump ..... A45F 5/02 206/223
8,684,789 B2 * 4/2014 Gramelspacher ..... A41C 3/00 450/92
8,881,652 B2 * 11/2014 Middo ..... B41J 11/06 101/474
8,990,965 B2 * 3/2015 Waldman ..... A41C 1/006 2/69
9,131,735 B2 * 9/2015 Cavosie ..... A41C 3/08
9,402,424 B2 * 8/2016 Roy ..... A41C 5/005
9,516,905 B2 * 12/2016 Pagnon ..... A41C 3/10
9,565,877 B2 * 2/2017 Martinet ..... A41C 3/065
9,578,901 B2 * 2/2017 Randall ..... A41C 3/02
9,585,423 B2 * 3/2017 Abasova ..... A41B 11/128
9,849,039 B2 * 12/2017 Collins ..... A61F 13/00038
10,165,803 B2 * 1/2019 Hoeven ..... A41B 17/00
10,194,701 B1 * 2/2019 Tufts ..... A61M 27/00
10,231,492 B1 * 3/2019 Bastug ..... A41C 3/10
10,694,788 B2 * 6/2020 Profeta ..... A41B 17/00
10,721,974 B2 * 7/2020 Bastug ..... A41C 3/0057
10,779,578 B2 * 9/2020 Van Tiel ..... A41B 11/121
10,918,141 B2 * 2/2021 Nordstrom ..... A41D 13/0015
11,432,596 B2 * 9/2022 Kobayashi ..... A41C 3/10
2008/0083052 A1 * 4/2008 Forbes ..... A41B 11/14 2/241
2010/0081984 A1 * 4/2010 Coffinardi ..... A41B 11/126 2/167
2011/0016607 A1 * 1/2011 Ashmore ..... A41B 11/126 450/94
2011/0112459 A1 * 5/2011 Mathieu ..... A41B 11/126 602/55
2014/0352032 A1 * 12/2014 Veneziani ..... A41B 11/123 2/239
2018/0116299 A1 * 5/2018 Zhang ..... A41B 11/126
2019/0289922 A1 * 9/2019 McFadyen ..... A41B 11/003
2019/0364999 A1 * 12/2019 Baschak ..... A41F 17/00
2020/0237023 A1 * 7/2020 Miller ..... A41B 11/128
2020/0260802 A1 * 8/2020 Van Tiel ..... A41B 11/126
2020/0308738 A1 * 10/2020 Lineberry ..... A41B 11/121
2020/0337385 A1 * 10/2020 Scott ..... A41B 11/10
2020/0383387 A1 * 12/2020 Lee ..... A41B 11/121

* cited by examiner

HIGH-ELASTIC, LIGHTWEIGHT AND COMFORTABLE UNDERWEAR AND A PRODUCTION PROCESS THEREOF

BACKGROUND OF THE INVENTION

1. Field of the Invention

The invention relates to the technical field of garment processing, in particular to a high-elastic, lightweight and comfortable underwear and a production process thereof.

2. Description of the Related Art

In the prior art, the underwear, shapewear, etc. generally have the problem of insufficient support for specific parts, and also insufficient binding force for specific parts, and the common solution is to overcome the problems is to use structural cutting and stitching and manufacture with the help of steel rings, rubber bands, stabilized yarn, lycra, hard fabrics and other accessories, however, the accessories may cause the skin to be squeezed, and is easy to deform after wearing and washing, therefore, a new type of high-elastic, lightweight and comfortable underwear needs to be studied urgently.

SUMMARY OF THE INVENTION

The invention aims to overcome the problems mentioned in the background art by providing a high-elastic, lightweight and comfortable underwear and a production process thereof.

In order to solve the problems in the prior, the invention provides the following technical schemes: a high-elastic, lightweight and comfortable underwear, comprising underwear inner-layer and underwear outer-layer, wherein elastomeric strips are provided between the underwear inner-layer and underwear outer-layer;

the elastomeric strips comprise boundary elastomeric strips, partial support elastomeric strips, and partial compression elastomeric strips.

Preferably, the boundary elastomeric strips are arranged at the boundary contour of the underwear, the partial support elastomeric strips are arranged under the chest and hips portion of the underwear, the partial compression elastomeric strips are arranged at abdomen area and around the hips, legs and arms portion.

Preferably, the material of the elastomeric strip is one of honey gel, silica gel, and clothing adhesive.

A production process of a high-elastic, lightweight and comfortable underwear, comprising the following steps:

1) printing the elastomeric strip shapes: setting print pattern, path and diameter of gel head, and printing the desired shape on the aluminum steel plate;
2) pressing elastomeric strips: pressing gel shape printed in advance to clothing panel of underwear inner-layer at low temperature, pressing the clothing panel of underwear inner-layer to clothing panel with elastomeric strips of underwear inner-layer at low temperature, and setting overall at high temperature;
3) cutting residual material: cutting off excess fabric on the outside of the elastomeric strips by using trimming machine;
4) finishing garment: stitching on garment accessories.

Preferably, the accessories comprise aiguillette, hooks and ornament.

Compared to the prior, the invention has the following advantageous effects: the invention is with simple structure and easy to manufacture, the invention can provide sufficient support and sufficient binding force for users while the skin is not be squeezed, the elastomeric strips can replace traditional rubber bands, steel rings, stabilized yarn, and etc, which has high-quality support performance to achieve shaping effect, and has excellent elasticity and resilience to facilitate design and manufacture with no worries of size, moreover, the invention is washable and not easy to deform.

Figure 1:
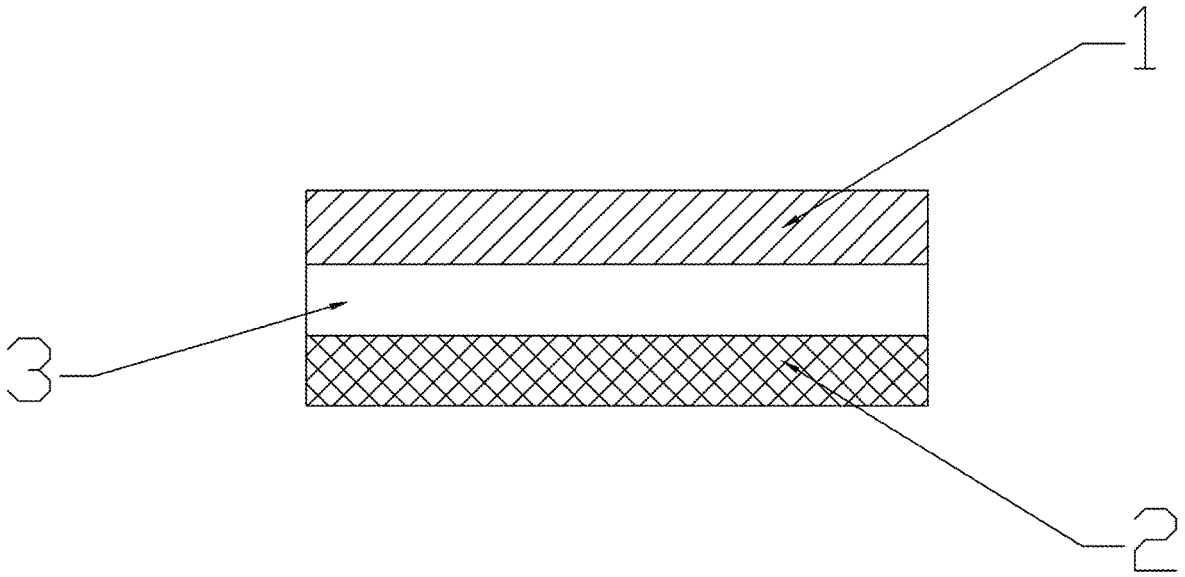
FIG. 1 shows the structure of the invention.
Figure 2:
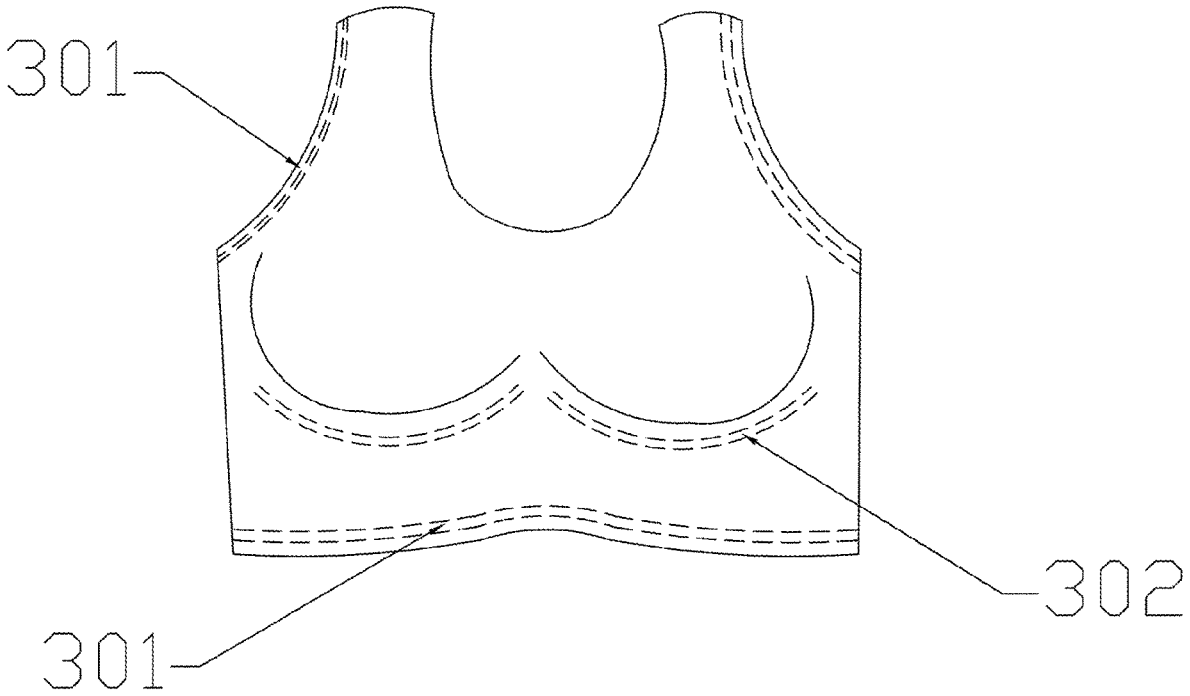
FIG. 2 shows the usage status 1 of the invention.
Figure 3:
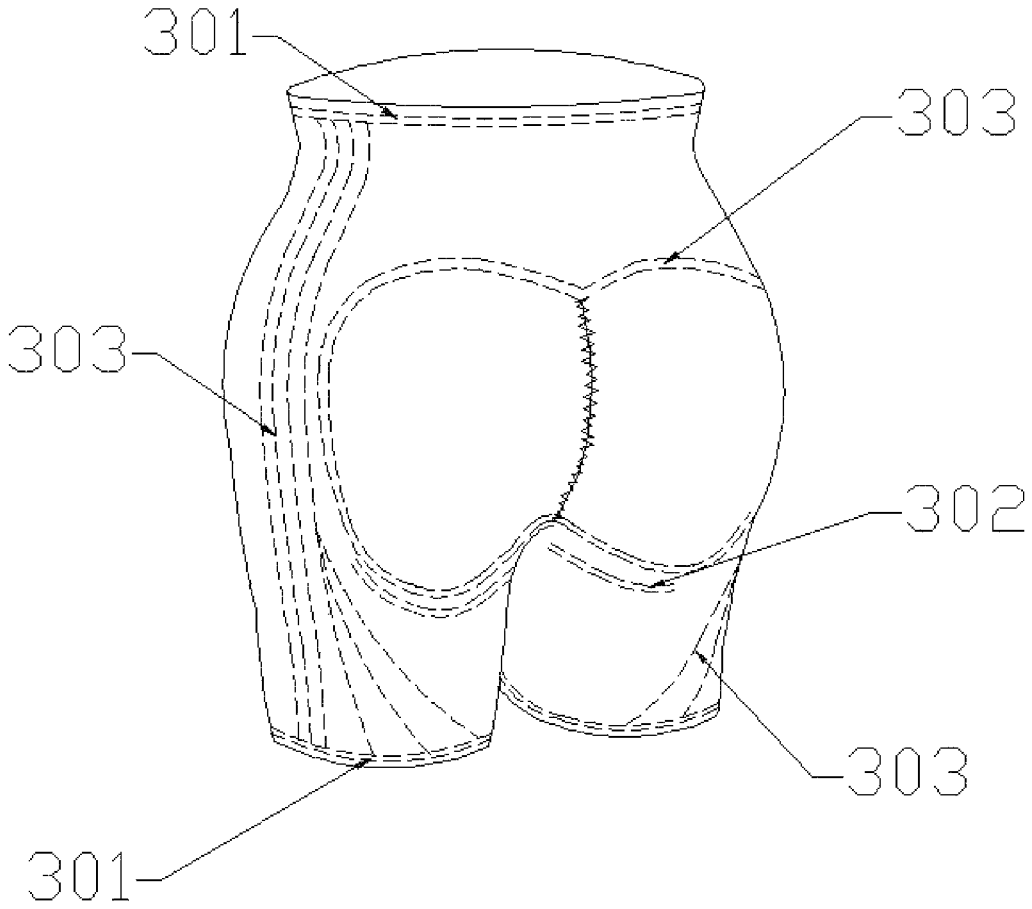
FIG. 3 shows the usage status 2 of the invention.
Figure 4:
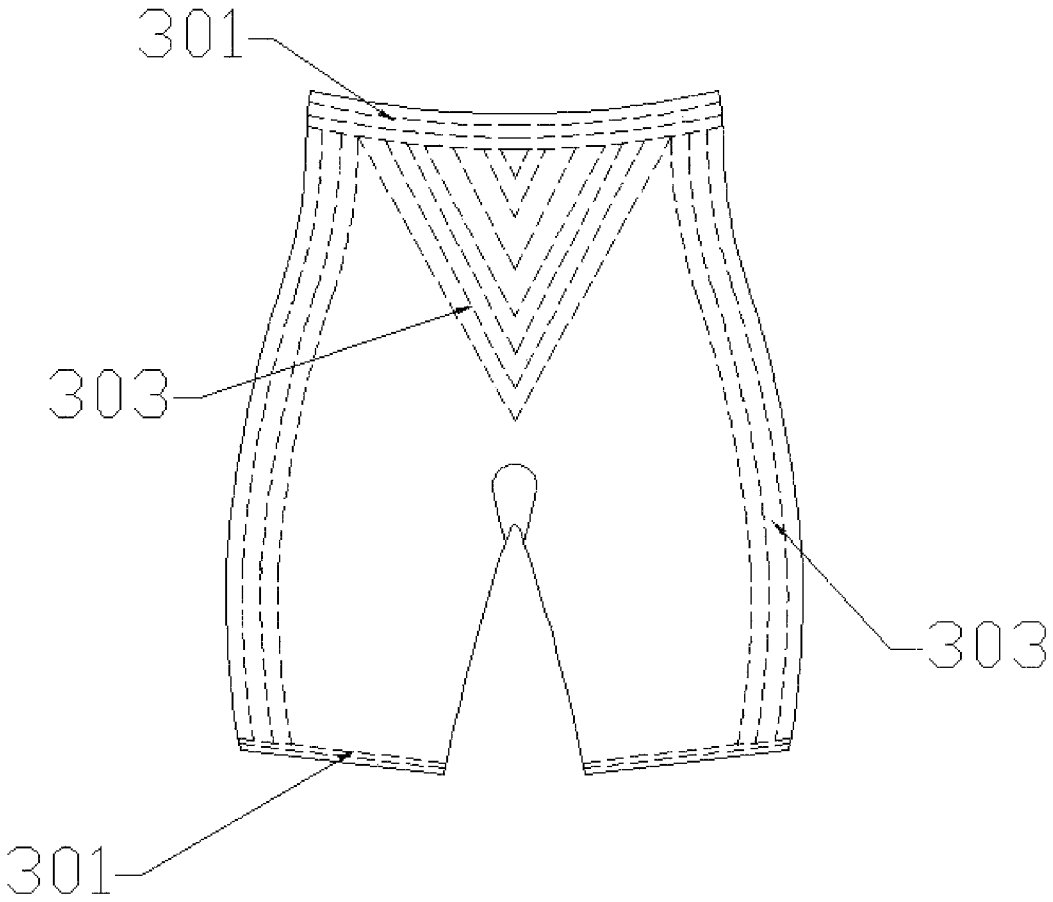
FIG. 4 shows the usage status 3 of the invention.

In the accompanying drawings: 1 refers to underwear inner-layer, 2 refers to underwear outer-layer, 3 refers to elastomeric strips, 301 refers to boundary elastomeric strip, 302 refers to partial support elastomeric strip, 303 refers to partial compression elastomeric strip.

DETAILED DESCRIPTION OF THE PREFERRED EMBODIMENTS

The technical schemes of the invention will be clearly and completely described below in reference with the accompanying drawings, obviously, the described embodiments are parts of the embodiments of the invention, rather than all of them. Based on the embodiments of the invention, all other embodiments obtained by those skilled in the art without creative work shall be included within the protection scope of the invention.

It should be understood that, in the description of the invention, the orientations or positional relationships indicated by the terms "center", "upper", "lower", "front", "rear", "left", "right", "vertical", "horizontal", "inside", "outside", "front", "back" etc., are based on the orientations or positional relationships shown in the drawings, and are only for the convenience of describing the invention and simplifying the description, and does not indicate or imply that the device or element referred to must have a specific orientation, structure and operation, therefore, the terms cannot be understood as a limitation to the invention. In addition, the terms "first", "second" and "third" are used for descriptive purposes, and cannot be understood as indicating or implying relative importance.

In the invention, the terms of "arrange", "link", "connect" and etc., should be generally understood unless there are specific restrictions or stipulations. For example, the "connect" may refer to fixed connection, detachable connection or integral connection; the "connect" may also refer to mechanical connection or electrical connection; the means of "connect" may be directly connected or indirectly connected through an intermediate medium, and may be internal communication between the two elements. For those skilled in the art, the specific meaning of the above terms in the invention can be understood according to the specific situation.

As shown in the accompanying drawings, a high-elastic, lightweight and comfortable underwear, comprising underwear inner-layer 1 and underwear outer-layer 2, wherein elastomeric strips 3 are provided between the underwear inner-layer 1 and underwear outer-layer 2;

the elastomeric strips 3 comprise boundary elastomeric strips 301, partial support elastomeric strips 302, and partial compression elastomeric strips 303.

The boundary elastomeric strips 301 are arranged at the boundary contour of the underwear, the partial support elastomeric strips 302 are arranged under the chest and hips portion of the underwear, the partial compression elastomeric strips 303 are arranged at abdomen area and around the hips, legs and arms portion.

The material of the elastomeric strip 3 is one of honey gel, silica gel, and clothing adhesive.

A production process of a high-elastic, lightweight and comfortable underwear, comprising the following steps:

1) printing the elastomeric strip 3 shapes: setting print pattern, path and diameter of gel head, and printing the desired shape on the aluminum steel plate;
2) pressing elastomeric strips: pressing gel shape printed in advance to clothing panel of underwear inner-layer 1 at low temperature, pressing the clothing panel of underwear inner-layer 2 to clothing panel with elastomeric strips of underwear inner-layer 1 at low temperature, and setting overall at high temperature;
3) cutting residual material: cutting off excess fabric on the outside of the elastomeric strips 3 by using trimming machine;
4) finishing garment: stitching on garment accessories.

The accessories comprise aiguillette, hooks and ornament.

The invention and embodiments thereof have been described above, and the description is not restrictive, the accompanying drawings are one of embodiments of the invention, and the actual structure of the invention is not limited thereto. In conclusion, any structural modes and embodiments similar to the technical schemes made by those skilled in the art, without departing from the inventive purpose of the invention and without creative design, should be included within the protection scope of the invention.

The invention claimed is:

1. A production process of the high-elastic, lightweight and comfortable underwear the underwear comprising underwear inner-layer and underwear outer-layer, elastomeric strips are provided between the underwear inner-layer and underwear outer-layer;

the elastomeric strips comprise boundary elastomeric strips, partial support elastomeric strips, and partial compression elastomeric strips;

the boundary elastomeric strips are arranged at the boundary contour of the underwear, the partial support elastomeric strips are arranged under the chest and hips portion of the underwear, the partial compression elastomeric strips are arranged at abdomen area and around the hips, legs and arms portion;

the material of the elastomeric strip is one of honey gel, silica gel, and clothing adhesive, comprising the following steps:

1) printing elastomeric strip shapes: setting a print pattern, path and diameter of a gel head, and printing desired shape on an aluminum steel plate;
2) pressing the elastomeric strips: pressing the elastomeric strip shapes obtained in step 1 to a clothing panel of underwear inner-layer at a low temperature, pressing a clothing panel of underwear outer-layer to the clothing panel with elastomeric strips of underwear inner-layer at a low temperature, and setting the overall at a high temperature;
3) cutting residual material: cutting off excess fabric on outside of the elastomeric strips by using trimming machine;
4) finishing garment: stitching on garment accessories.

* * * * *